US006478648B1

(12) United States Patent
Applewhite et al.

(10) Patent No.: US 6,478,648 B1
(45) Date of Patent: Nov. 12, 2002

(54) TOY ROCKET WITH PARACHUTE HATCH RELEASE

(75) Inventors: John T. Applewhite, Marietta, GA (US); Reynaldo Aratea, Woodstock, GA (US)

(73) Assignee: Johnson Research & Development Company, Smyrna, GA (US)

( * ) Notice: Subject to any disclaimer, the term of this patent is extended or adjusted under 35 U.S.C. 154(b) by 0 days.

(21) Appl. No.: 09/571,366

(22) Filed: May 15, 2000

(51) Int. Cl.[7] ..... A63H 33/20
(52) U.S. Cl. ..... 446/52; 446/51; 446/49
(58) Field of Search ..... 446/49, 50, 51, 446/52, 53

(56) References Cited

U.S. PATENT DOCUMENTS

| | | | | |
|---|---|---|---|---|
| 1,486,215 A | | 3/1924 | Zerbee | |
| 1,635,823 A | * | 7/1927 | Di Giulio | 446/49 |
| 1,713,432 A | | 5/1928 | Griggs | |
| 1,938,931 A | | 12/1933 | Newman | |
| 2,008,107 A | | 7/1935 | Norden | 46/52 |
| 2,023,124 A | | 12/1935 | Dickover | 46/86 |
| 2,126,156 A | | 8/1938 | Vogt | 46/86 |
| 2,312,629 A | | 3/1943 | Culver et al. | 46/86 |
| D158,700 S | | 5/1950 | Weldon | D34/15 |
| 2,559,458 A | | 7/1951 | Orr | 46/86 |
| 2,568,475 A | | 9/1951 | Vaughan | 46/86 |
| 2,607,159 A | | 8/1952 | Hunt et al. | 46/86 |
| 2,733,699 A | | 2/1956 | Krinsky | 124/13 |
| 2,784,712 A | | 3/1957 | Cassidy | 124/11 |
| 3,086,317 A | | 3/1960 | Quercetti | 46/74 |
| 3,046,966 A | | 7/1962 | Butler et al. | 124/11 |
| 3,370,378 A | * | 10/1965 | Simonini, Jr. | 446/49 |
| 3,218,755 A | | 11/1965 | Quercetti | 46/86 |
| 3,375,606 A | * | 4/1968 | Francis | 446/49 |
| 3,415,010 A | | 12/1968 | Belz | 46/241 |
| 3,739,764 A | | 6/1973 | Allport | 124/11 |
| 3,822,502 A | | 7/1974 | Belz | 46/241 |
| 4,038,776 A | | 8/1977 | Filipeli | 46/76 |
| 4,159,705 A | | 7/1979 | Jacoby | 124/63 |
| 4,223,472 A | | 9/1980 | Fekete et al. | 46/44 |
| 4,304,213 A | | 12/1981 | Jereckos | 124/69 |
| 4,601,278 A | | 7/1986 | Kim | 124/57 |
| 4,840,598 A | | 6/1989 | Schuetz | 446/52 |
| 5,381,778 A | | 1/1995 | D'Andrade et al. | 124/69 |
| 5,407,375 A | * | 4/1995 | Johnson | 446/52 |
| 5,549,497 A | * | 8/1996 | Johnson et al. | 446/52 |
| 5,951,354 A | * | 9/1999 | Johnson | 446/52 |

FOREIGN PATENT DOCUMENTS

| | | | | |
|---|---|---|---|---|
| FR | 1359978 | * | 4/1963 | 446/52 |

* cited by examiner

*Primary Examiner*—Derris H. Banks
*Assistant Examiner*—Urszula M Cegielnik
(74) *Attorney, Agent, or Firm*—Baker, Donelson Bearman & Caldwell

(57) ABSTRACT

A rocket (10) is disclosed having a body (11) with a bay (13) therein and hatch (16) which is movable between a bay opened position and a bay closed position by a spring biased hinge (19). The hatch is coupled to a two stage catch (29). A parachute (23) is mounted to the hatch. Upon initial movement of the rocket the hatch is partially unlatched, the upon the near completion of forward movement the latch completely releases the hatch so as to pull the parachute from the bay for deployment.

22 Claims, 2 Drawing Sheets

TOY ROCKET WITH PARACHUTE HATCH RELEASE

TECHNICAL FIELD OF THE INVENTION

The present invention relates generally to toy rockets and more particular to toy and model rockets having deployable parachutes.

BACKGROUND OF THE INVENTION

For decades, toy rockets have been popular playthings for children of all ages. Such rockets have been made available in all shapes and sizes and many models have been provided with their own propellant, such as pressurized water, pressurized air, or the like. The popularity of toy rockets has even extended to adolescent and adult hobbies in the form of model rockets propelled by solid fuel rocket engines. As a matter of fact, model rocket enthusiasts often spend countless hours constructing model rockets that are large and extremely realistic. Such model rockets typically require a substantial financial investment and can be extremely valuable items for their owners.

Most toy rockets that have been the playthings of children are designed to be launched by one of various means into the air for flight. Rarely, however, have toy rockets been provided with deployable parachutes. Thus, once launched, toy rockets simply follow a trajectory up and then back down to the ground where they impact the earth. Since toy rockets are sturdy and follow relatively low altitude trajectories, their impact with the ground rarely causes damage and they are simply retrieved and launched again.

One type of toy rocket that functions in this way is commonly known as the "Nerf®" rocket. Nerf rockets usually have an elongated cylindrical fuselage that is made of a foam rubber material and that has fins affixed to and extending outwardly from the tail of the rocket. In use, nerf rockets, like many other toy rockets, are propelled from a launcher by means of compressed air, whereupon they follow natural trajectories up and back to the earth.

In contrast to toy rockets, model rockets that are propelled by solid fuel rocket engines commonly are provided with parachutes that are deployed during flight of the rocket to ease the rocket gently back to the earth when its engines are spent. A parachute is desirable for model rockets because these rockets typically are heavier and more fragile than toy rockets and are propelled to much higher altitudes. Accordingly, if these model rockets are allowed to fall naturally back to earth, they can easily be destroyed upon impact with the ground. This is a particularly acute problem with large expensive model rockets, which sometimes include parachutes for each stage as well as redundant parachutes for more expensive portions of the rocket.

In model rockets, the parachute usually is folded and stowed in the nose-cone section of the rocket during flight. For deployment of the parachute, the nose-cone typically is ejected by means of an explosive charge that is activated as the rocket's engines burn out. With the nose-cone thus ejected, the parachute can unfold and deploy for easing the rocket body back to earth.

While such methods of deploying parachutes from model rockets have been relatively successful in the past, they nevertheless have been plagued with numerous problems and shortcomings inherent in their respective designs. For example, the explosive charge that ejects the nose-cone and deploys the chute usually is triggered by the burning engine of the model rocket. Ideally, it is desirable that the explosive charge occur after the engine has burned out. However, such accurate timing has proved elusive such that chute deployment sometimes occurs while the main engine is still burning or occurs after the rocket has reached apogee and is falling back to earth. In addition, the explosive charges that deploy the chutes must be replaced after each flight, which is tedious and time consuming and can become expensive after numerous flights. Also, it is not uncommon that the explosive charge designed to deploy the parachute fails to fire, whereupon a potentially expensive model rocket plummets back to earth and is destroyed.

As mentioned above, unlike model rockets, most toy rockets are not provided with parachutes. This is because toy rockets usually are inexpensive and rugged enough to withstand and impact with the earth. Further, there has previously been no convenient method of deploying a parachute from a toy rocket since there is no burning engine that can be used to trigger a chute deployment charge. Nevertheless, parachutes have been found to be amusing to children who play with toy rockets. It is thus desirable that toy rockets do deploy parachutes at the apogees of their trajectories to ease them back to earth and, in the process, to amuse their owners.

In the past, a few toy rockets have been provided with makeshift parachutes, but the chutes usually are simply wrapped around the body of the rocket and the rocket thrown or propelled into the air. With these types of toy rockets, the chute simply unwinds as the rocket tumbles upwardly through the air and, when fully unwound, deploys to stop the upward movement of the rocket and ease it back to earth. Obviously, such a method of stowing and deploying a parachute is highly undesirable since the rocket tends to tumble as it moves upwardly and does not fly straight through the air. Further, the time at which the chute deploys is completely uncontrollable and the chute rarely deploys at the apogee of the rocket's trajectory, where deployment is most desirable.

Recently, rockets have been designed with velocity dependent parachute releases, as shown in applicant's U.S. Pat. Nos. 5,407,375 and 5,549,497. These rockets utilize hatches with latches which become unlatched during initial propulsion of the rocket. The unlatched hatch is suppose to open when the wind resistance upon the hatch becomes minimal. The problem however associated with these rockets has been the accuracy relating to the opening of the hatch as the force of the hatch spring must overcome the wind resistance at low velocities to open the hatch while still be weak enough not to overcome the force of the wind resistance upon the hatch during normal flight. As such, these rockets are prone to the latch prematurely opening prior to reaching its apogee resulting in a shortened flight or remaining closed through the apogee causing the parachute not to be deployed at all.

Accordingly, it is seen that a need remains for a rocket which may deploy a parachute and a reliably manner. It is to the provision of such therefore that the present invention is primarily directed.

SUMMARY OF THE INVENTION

In a preferred form of the invention a rocket comprises a body having a forward end relative to the direction of initial rocket propulsion and a rearward end opposite the forward end, and a hatch movably mounted to the body for movement between a closed and opened position through a hinge. The rocket also has descent control means actively coupled to the hatch and a latch coupled to the hatch. The latch is movable from a latched position maintaining the hatch in its closed position to a semi-unlatched position partially releasing the hatch upon initial forward movement of the rocket. The latch is also moveable from its semi-unlatched position to a fully unlatched position releasing the hatch as the rocket's forward movement nears arrestment. With this construction and with the forward movement of the rocket, the latch is moved to a semi-unlatched position which still maintains the hatch in a closed position, but as the rocket slows near its apogee the latch is moved to its fully released position so as to open the hatch and cause the deployment of the descent control means.

DETAILED DESCRIPTION OF THE PREFERRED EMBODIMENT

Figure 1:
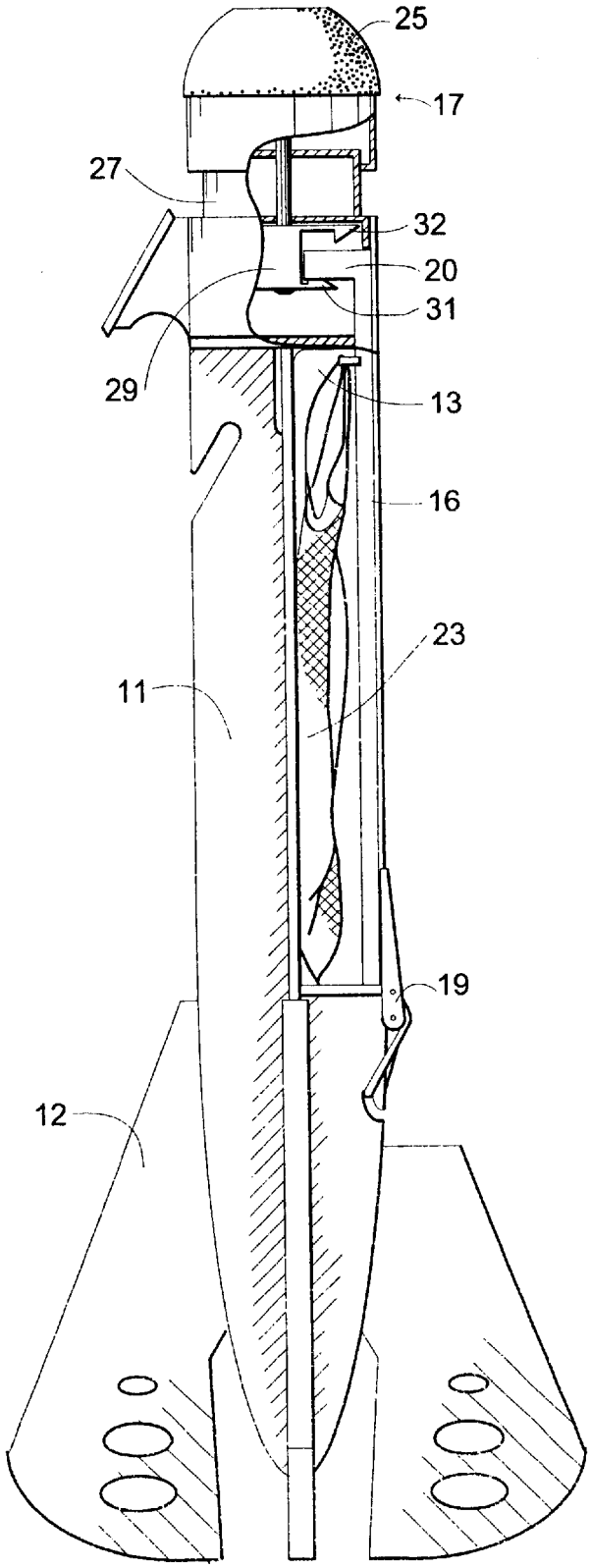
FIG. 1 is a front view, shown in partial cross-section, of a rocket embodying principles of the invention in a preferred form.

Referring next to the drawing, there is shown a rocket 10 embodying principles of the invention in a preferred form. The rocket 10 has a generally cylindrical elongated fuselage body 11 having a rearward end with an annular array of fins 12, a cavity or bay 13 within the body covered by a hatch 16, and a nose section 17.

Figure 2:
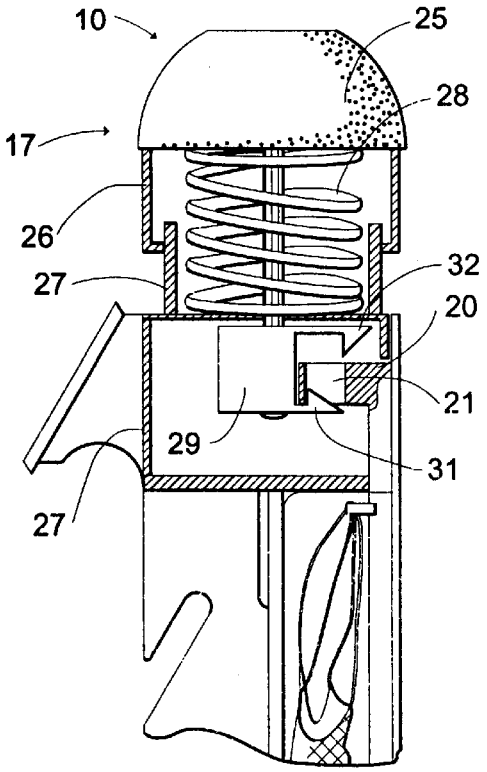
FIGS. 2–4 are a sequence of partial cross-sectional views showing a portion of the rocket of FIG. 1, which show, in sequence, the rocket in a static condition prior to launch, in an initial in-flight condition and in a hatch opened condition.
Figure 4:
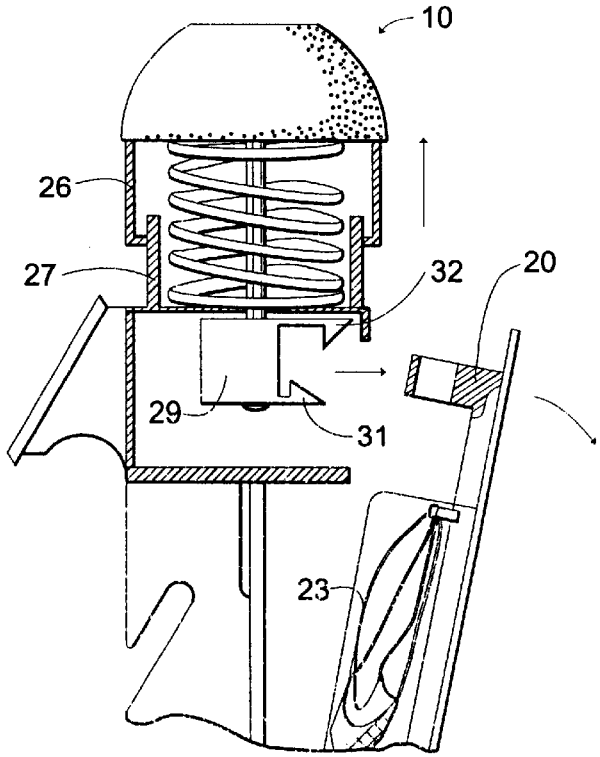

The hatch 16 is pivotally mounted at a lower end thereof to the body 11 by a spring biased hinge 19 which enables the hatch to be pivoted between a bay closed position, shown in FIGS. 1 and 2, and a bay open position, shown in FIG. 4. The biasing force of the spring biased hinge 19 moves the hatch 16 towards its bay open position. The hatch 16 has a catch bar 20, with an elongated opening 21 therethrough, extending from the top end of the hatch opposite the hinge 19. The rocket 10 also has a parachute 23 secured to the hatch 16.

Figure 3:
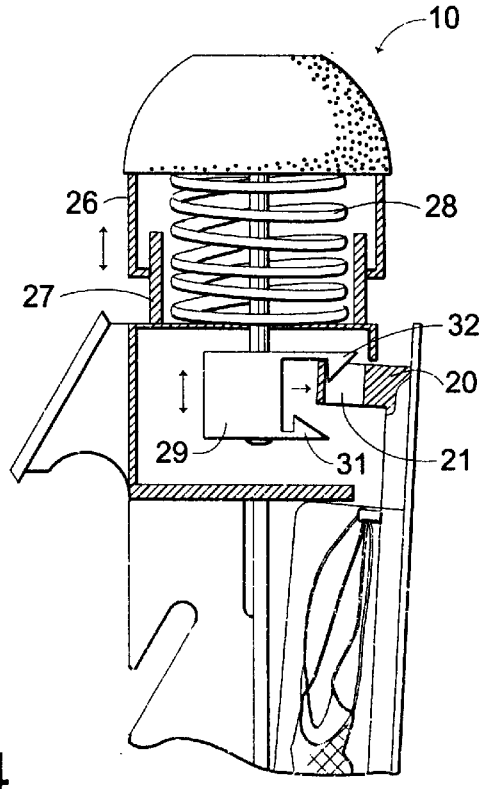

The nose section 17 has a nose-cone 25 having a cylindrical first portion 26 sized and shaped to be telescopically mounted to a second portion 27 for reciprocal movement between an extended position, shown in FIGS. 1, 2 and 4 and a depressed position, shown in FIG. 3. A spring 28 is mounted between the first and second portions 26 and 27 SO as to bias the first portion 26 towards its extended position. The first portion 26 is coupled to a catch 29 having a lower tang 31 adapted to be received within the opening 21 of the catch bar 20 and an upper tang 32, offset from the lower tang 31, adapted to be received within the opening 21 of the catch bar.

In use, the rocket 10 is positioned upon a launcher, of any type, with the parachute 23 stowed within bay 13. With the rocket 10 in a static position, as shown in FIGS. 1 and 2, the catch lower tang 31 is captured within the opening 21 of the catch bar 20. The spring 28 biases the nose cone first portion 26, and thus the catch 29, in an upwards direction to ensure that the catch 29 is maintained in a latched position. This positioning of catch 29 prevents the hatch 16 from being spring biased to its bay open position by hinge 19.

As shown in FIG. 3, upon initial launch of the rocket 10 the inertia of the nose section 17 and/or the initial wind resistance upon the nose section causes the nose-cone first portion 26 to move downward to its depressed position. This downward movement of the first portion moves the catch 29 downward thereby partially releasing the hatch 16 as the lower tang 31 is removed from the catch bar opening 21. With the nose-cone first portion 26 in its depressed position the catch upper tang 32 is captured within the opening 21 of the catch bar 20, and thus the hatch 16 is still mechanically maintained in its bay closed position, as such this is referred to herein as a semi-unlatched position.

As shown in FIG. 4, once the rocket 10 approaches its apogee, and therefore its forward movement has neared arrestment, the force of the wind upon the nose section 17 becomes less than the biasing force of spring 28, thereby causing the spring 28 to bias the nose-cone first portion 26 towards its extended position. With the movement of the nose-cone first portion 26 to its extended position the catch upper tang 32 is retracted from the catch bar opening 21, thereby releasing the catch bar 20 from the catch 29. With the release of the catch bar 20 the spring biasing hinge 19 moves the hatch 16 to its bay open position, which also causes the parachute 23 to be pulled from within the bay 13.

It should be understood that the catch of the present invention works in two stages, an initial, partial release of the catch with forward movement of the rocket followed by the complete release of the catch upon the near completion of forward movement. The partial release of the catch, and therefore the hatch, however still ensures that the hatch remains in a bay closed position to prevent the parachute from being deployed prior to the termination of forward movement without relying upon the wind resistance upon the hatch to maintain the hatch closed, as with rockets of the prior art. The combination of the catch bar and catch constitutes an inertially activated and/or wind resistant activated latch mechanism.

It should be understood that the present invention may incorporate other conventional descent control means as an alternative to the parachute described in the preferred embodiment. As such, the rocket may include a deployable wing, helicopter type blades, streamers or similar type devices. A rocket utilizing such alternative devices would still activate the deployment of such devices with the opening of the hatch as previously described or directly deploy the descent means, as for example, with the deployment of a wing directly coupled to the body of the rocket and the latch. Also, it should be understood that the positions of the catch bar 20 and catch 29 may be reversed, i.e. the catch bar may be mounted to the rocket body and the inertially activated and/or air resistive catch 29 may be mounted to the hatch. Lastly, it should be understood that rather than having the nose cone portions being mounted telescopically with respect to each other, the nose cone may be mounted with a peripheral hinge and a catch mounted opposite the hinge.

It thus is seen that a rocket in now provided which includes a hatch which is latched in a manner that ensures the opening of the hatch and the release of the parachute in an effective manner without doing so prematurely. While this invention has been described in detail with particular references to the preferred embodiment thereof, it should be understood that many modifications, additions and deletions, may be made thereto without departure from the spirit and scope of the invention as set forth in the following claims.

What is claimed is:

1. A rocket comprising:

a body having a forward end relative to the direction of initial rocket propulsion and a rearward end opposite said forward end;

a hatch movably mounted to said body for movement between a closed and opened position, said hatch being pivotally mounted to said body by a hinge;

a descent control means actively coupled to said hatch;

a latch coupled to said hatch, said latch being movable from a latched position maintaining said hatch in its closed position to a semi-unlatched position partially releasing said hatch upon initial forward movement of said rocket, and said latch being movable from said semi-unlatched position to a fully unlatched position releasing said hatch as said rocket's forward movement nears arrestment, said latch includes a catch and a catch bar having an opening therein, said catch having a first tang engaging said catch bar with said latch in its latched position and a second tang engaging said catch bar with said latch in its semi-unlatched position, whereby with the forward movement of the rocket the latch is moved to a semi-unlatched position which still maintains the hatch in a closed position, but as the rocket slows near its apogee the latch is moved to its fully released position so as to open the hatch causes the deployment of the descent control means.

2. The rocket of claim 1 wherein said descent control means is a parachute.

3. The rocket of claim 2 wherein said body has a bay and wherein said parachute is stowed within said bay with the hatch in its closed position substantially covering said bay.

4. The rocket of claim 1 further comprising a movable nose cone, and wherein said latch is operably coupled to said movable nose cone, whereby the movement of the nose cone actuates the unlatching of the catch.

5. The rocket of claim 1 further comprising a movable nose cone, and wherein said latch is operably coupled to said nose cone.

6. The rocket of claim 5 further comprising a spring operably coupled to said catch for biasing said catch to its fully unlatched position.

7. The rocket of claim 5 wherein said catch is operably coupled to said nose cone.

8. The rocket of claim 1 further comprising a spring biasing said latch to its latched position and its fully unlatched position.

9. A rocket comprising:

a body having a forward end and a rearward end relative to the direction of initial rocket propulsion;

a hatch movably mounted to said body for movement between a closed position and an opened position;

a latch coupled to said hatch, said latch being moveable between a latched configuration engaging said hatch with said rocket in a static condition, a semi-unlatched position subsequent to launch and prior to near rocket apogee, and a fully unlatched position disengaging said hatch when said rocket is approximate its apogee, said latch includes a catch and a catch bar having an opening therein, said catch having a first tang engaging said catch bar with said latch in its latched position and a second tang engaging said catch bar with said latch in its semi-unlatched position;

descent control means operably coupled to said hatch;

whereby with the forward movement of the rocket the latch is moved to a semi-unlatched position which still maintains the hatch in a closed position, but as the rocket slows as it approaches its apogee the latch is moved to its fully released position so as to open the hatch causes the deployment of the descent control means.

10. The rocket of claim 9 wherein said descent control means is a parachute.

11. The rocket of claim 10 wherein said body has a bay and wherein said parachute is stowed within said bay with the hatch in its closed position substantially covering said bay.

12. The rocket of claim 9 further comprising a movable nose cone, and wherein said latch is operably coupled to said nose cone.

13. The rocket of claim 9 further comprising a movable nose cone, and wherein said latch is operably coupled to said nose cone.

14. The rocket of claim 13 further comprising a spring operably coupled to said catch for biasing said catch to its fully unlatched position.

15. The rocket of claim 13 wherein said catch is operably coupled to said nose cone.

16. The rocket of claim 9 further comprising a spring biasing said latch to its latched position and its fully unlatched position.

17. A rocket comprising:

a body having a forward end relative to the direction of initial rocket propulsion and a rearward end opposite said forward end;

descent control means movably mounted to said body for movement between a stowed and deployed position;

a latch coupled to said descent control means, said latch being movable from a latched position maintaining said descent control means in its stowed position to a semi-unlatched position partially releasing said descent control means upon initial forward movement of said rocket, and said latch being movable from said semi-unlatched position to a fully unlatched position releasing said descent control means as said rocket's forward movement nears arrestment, said latch includes a catch and a catch bar having an opening therein, said catch having a first tang engaging said catch bar with said latch in its latched position and a second tang engaging said catch bar with said latch in its semi-unlatched position, whereby with the forward movement of the rocket the latch is moved to a semi-unlatched position which still maintains the descent control means in a stowed position, but as the rocket slows near its apogee the latch is moved to its fully released position so as to deploy the descent control means.

18. The rocket of claim 17 wherein said descent control means includes a hatch coupled to said body.

19. The rocket of claim 17 wherein said descent control means is a parachute.

20. The rocket of claim 17 further comprising a movable nose cone, and wherein said latch is operably coupled to said nose cone.

21. The rocket of claim 17 further comprising a movable nose cone, and wherein said latch is operably coupled to said nose cone.

22. The rocket of claim 21 wherein said catch is operably coupled to said nose cone.

* * * * *